United States Patent [19]

Petro

[11] Patent Number: 4,777,981

[45] Date of Patent: Oct. 18, 1988

[54] MAGNETIC DETENT JOY STICK AND STACK REMOTE CONTROL VALVES

[75] Inventor: John D. Petro, Hubbard, Ohio

[73] Assignee: Commercial Shearing, Inc., Youngstown, Ohio

[21] Appl. No.: 50,788

[22] Filed: May 18, 1987

[51] Int. Cl.[4] ..... F15B 13/04

[52] U.S. Cl. ..... 137/636.2; 137/596; 137/625.68; 251/65; 251/297

[58] Field of Search ..... 137/596, 625.68, 636.2; 251/65, 297

[56] References Cited

U.S. PATENT DOCUMENTS 4,342,335 8/1982 Reinicker et al. ..... 137/596 X

*Primary Examiner*—Gerald A. Michalsky

*Attorney, Agent, or Firm*—Buchanan Ingersoll; Lynn J. Alstadt

[57] ABSTRACT

A magnetic detent joy stick and stack remote control valve is provided having a traction magnet detent in which a magnet plate activated by the detent is constantly urged against the coil housing to prevent dirt from getting between the coil plate and coil housing face when the power is cut off and/or the valve is in neutral.

5 Claims, 4 Drawing Sheets

MAGNETIC DETENT JOY STICK AND STACK REMOTE CONTROL VALVES

This invention relates to magnetic detent joy stick and stack remote control valves and particularly to a remote control assembly for stack valves having a traction magnet detent design in which the magnet plate is resiliently urged against the magnet coil housing to prevent dirt from getting between the coil plate and coil housing face when power is cut off.

Joy stick controls for remote control valves have been used for some time. A very real problem has existed in that particles of dirt tend to accumulate between the coil plate and coil housing face. This greatly reduces the traction detent force generated by the applied coil voltage because of the air gap generated by dirt or other material in the space between the coil plate and coil housing face.

The present invention provides a solution to this problem and effectively eliminates the possibility of dirt accumulating between the coil plate and coil housing face and the resultant formation of an undesirable air gap between them.

I provide a magnetic joy stick and stack remote control structure having a housing with inlet and outlet chambers separated by a common inner wall, an inlet port in the housing communicating with the inlet chamber, an outlet port communicating with the outlet chamber, at least one control valve port in the housing communicating with the inlet chamber, a valve member slidable in said control valve port and connecting the control valve port with the inlet chamber in a first position and with the outlet chamber in a second position, a resiliently biased valve operator normally holding the valve in the second position, a joy stick pivoted on the housing to engage said valve operator to move the valve between the first and second position, a magnetic coil adjacent the valve operator, a detent pin movable centrally in said coil, means at one end for holding said valve operator in the first position, a coil plate on said coil in contact with the detent pin opposite said means for holding the valve operator in the first position and resilient means urging said coil plate toward the coil whereby the coil plate is in constant contact with the coil except when the detent pin forces the coil plate away from the coil when the joy stick is moved to operate the valve from one of the first to second positions. Preferably, the housing is made in two parts with a portion of the common wall in each. The valve member is preferably an elongate cylindrical member having a central bore open at the end in said control valve port and closed at the opposite end with transverse bore holes communicating with the central bore adjacent said other end. Preferably, the resilient biased valve operator is made up of a foot plate bearing on the control valve at the end remote from the control port, a spaced head member, resilient means urging said foot plate and head member apart, a telescopic connector member between said foot plate and head member and a resilient means in the outlet chamber urging the head member away from the valve member. The means at one end of the detent pin for holding the valve in the first position may be a detent plate pivotally attached to the joy stick intermediate its ends or it may be a transversely moving friction member. Preferably, the inlet chamber is provided with an outlet port to a next adjacent valve section.

In the foregoing general description of this invention I have set out certain objects, purposes and advantages of this invention. Other objects, purposes and advantages of the invention will be apparent from a consideration of the following description and the accompanying drawings in which.

Figure 2:
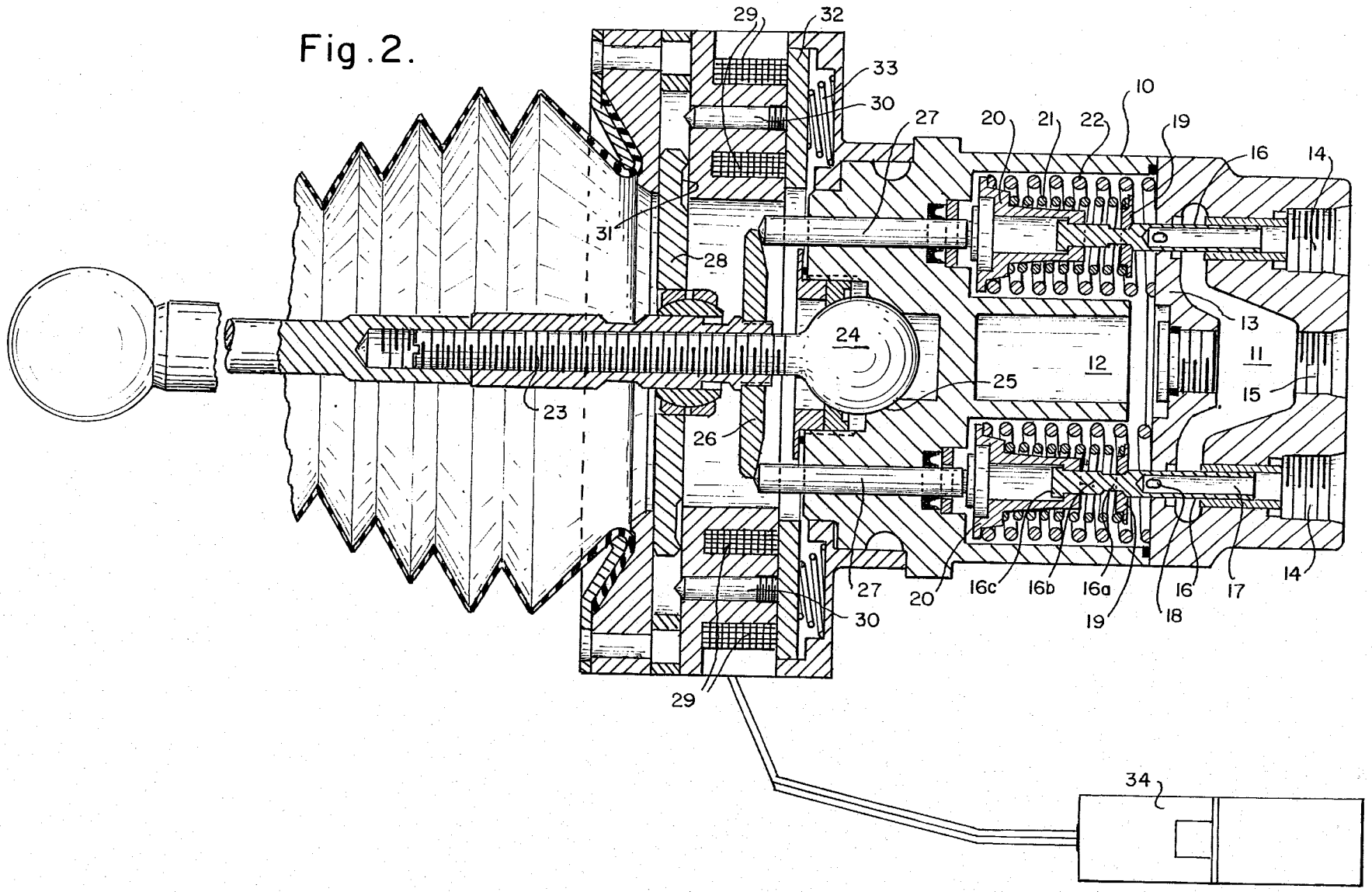
FIG. 2 is a section through the embodiment of the invention of FIG. 1 on the line II—II.

Referring to the drawings and particularly to FIG. 2, I have illustrated a magnetic joy stick and stack valve assembly having a housing 10 with an inlet chamber 11 and an exhaust chamber 12 separated by a common wall 13. The inlet chamber is provided with control ports 14 which may be connected to a working element such as a hydraulic cylinder and an inlet port 15 which may be connected to a source of high pressure fluid such as a pump. Each control port 14 carries an elongate valve element 16 having a hollow axial bore 17 extendig from one end open to the control port to a point short of the opposite end. Transverse bore holes 18 are provided through the wall of the valve element 16 at the end of bore 17 adjacent the opposite end. These bore holes communicate in a first position with inlet chamber 11 and in a second postion with outlet chamber 12. The valve element 16 is provided at the opposite end from the control port with a reduced section portion **16*a* carrying a foot plate 19, a slightly larger telescoping portion 16*b* and a head 16*c* which is telescopically slidable in a separate head member 20. The head member 20 and foot plate 19 are urged apart by spring 21. The head member 20 is urged by a second spring 22, bearing on common wall 13, away from said common wall. A joy stick 23 having a ball 24 at one end is pivoted on said ball 24 in a ball socket 25 in the housing. The joy stick carries an operator plate 26 adjacent the ball which bears on one end of operator rods 27. The other end of operator rods 27 bear on head member 20 to move it toward common wall 13 and to apply pressure on foot plate 19 through spring 21 to actuate valve member 16. Spaced from operator plate 26 a detent plate 28 is pivotally carried on joy stick 23. This plate moves across magnetic coils 29 to depress detent pin 30 to permit the detent 31 in detent plate 28 to be engaged by detent pin 30. When pin 30 is depressed in coil 29 it urges coil plate 32 away from the coil against spring 33. The spring 33 acts on coil plate 32 to maintain it in position on the coil at all times regardless of whether current is coming into the coil from power source 34 or not. This prevents particles of dirt or dust from accumulating between the coil plate 32 and coil 29**. This is very important because the traction detent force generated from the applied coil voltage is greatly reduced when an air gap between the coil plate and coil housing is created by dirt or other means.

Figure 1:
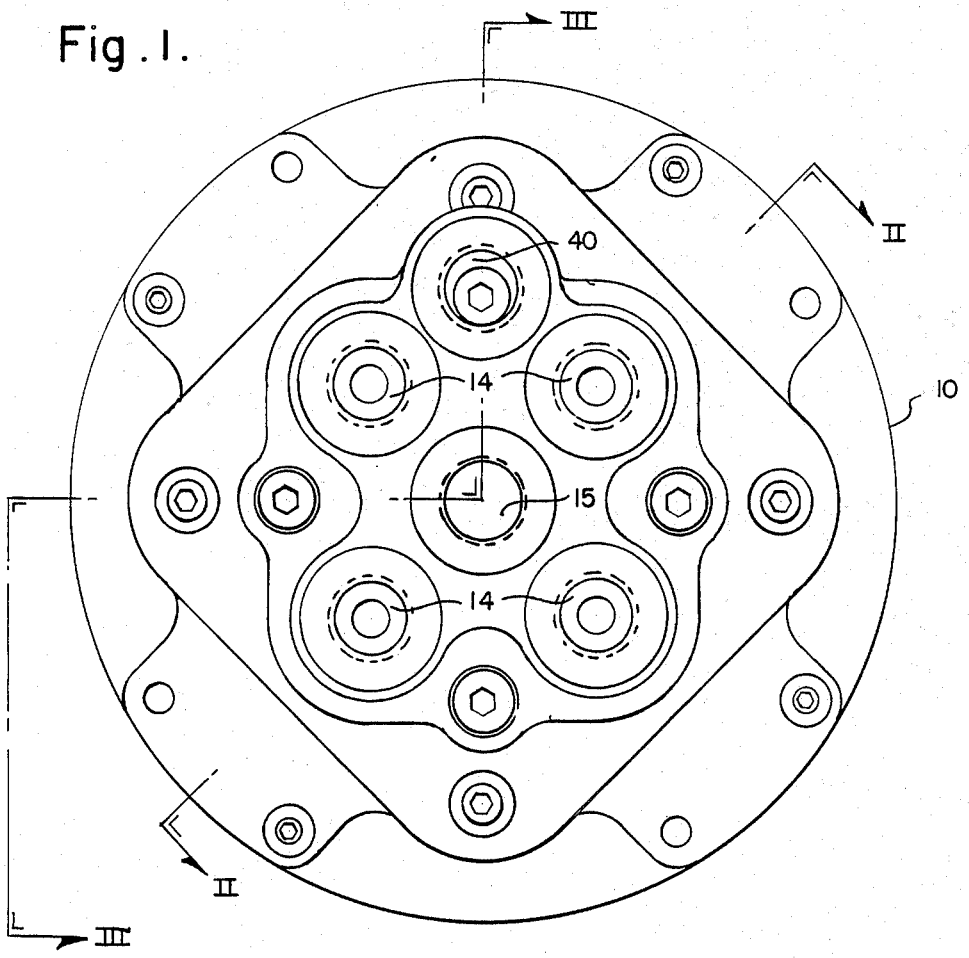
FIG. 1 is a bottom end view of one embodiment of this invention.
Figure 3:
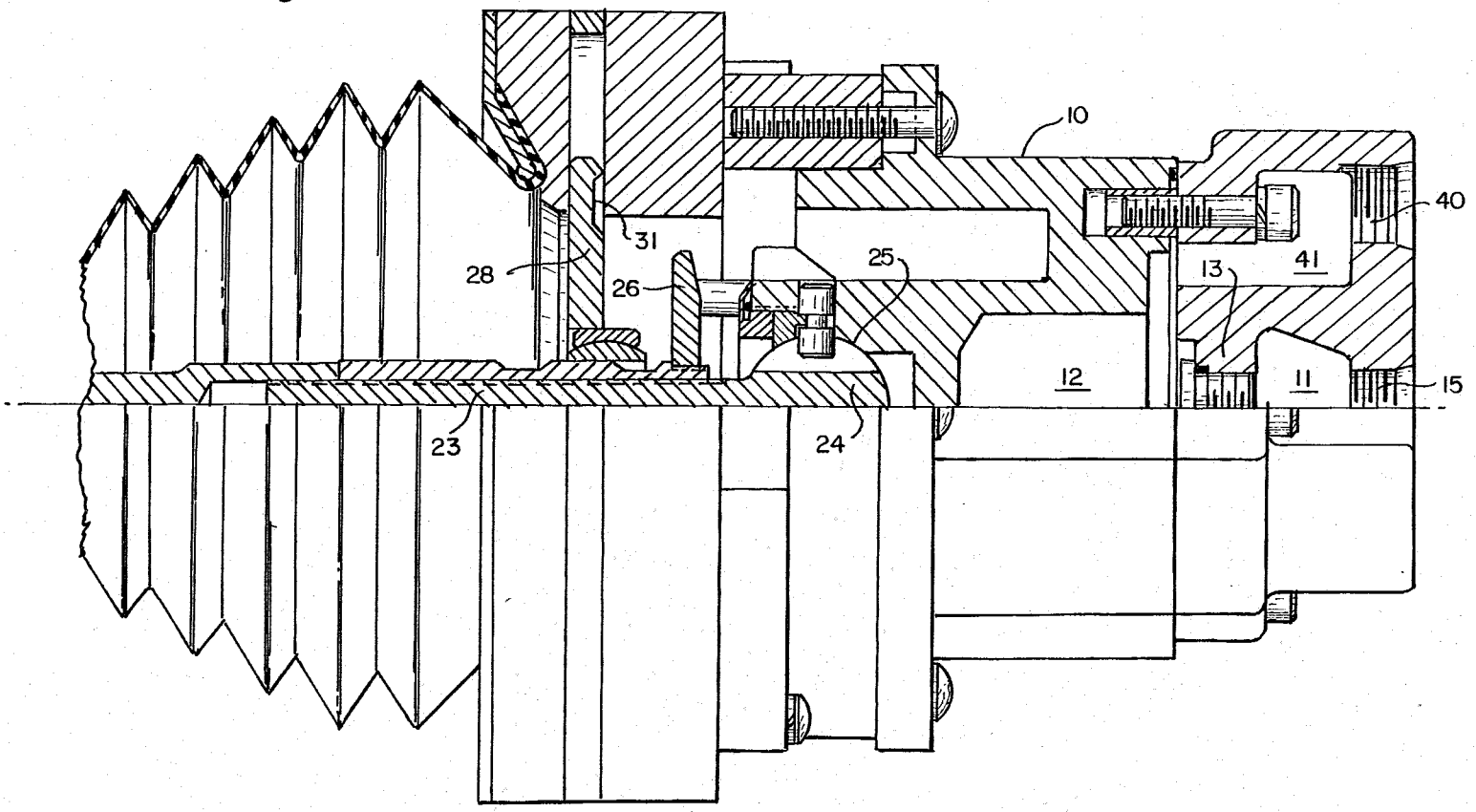
FIG. 3 is a fragmentary section of the embodiment of FIG. 1 on the line III—III.

In the embodiment of FIGS. 1 through 3, four control ports are provided as indicated in FIG. 1 and each is controlled as above described. In addition, in this embodiment an outlet port 40 is provided to tank. This outlet port 40 is connected to the outlet chamber 12 by means of an outlet passage 41 in the housing as illustrated in FIG. 3.

Figure 4:
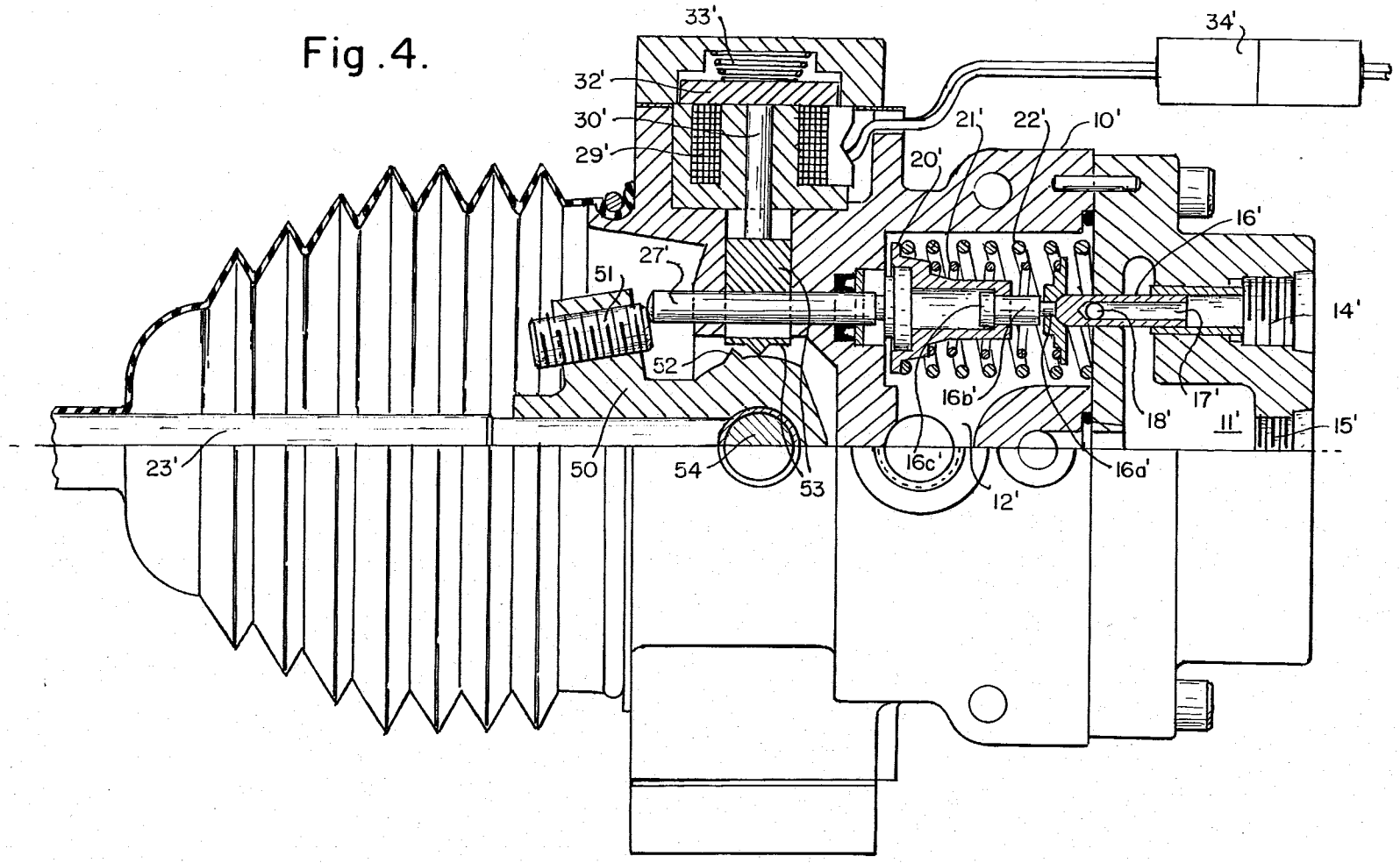
FIG. 4 is a fragmentary section of a second embodiment of this invention.

In the embodiment of FIG. 4 I have illustrated a two control port form of valve according to this invention. Those portions which are essentially the same as FIGS. 1–3 are identified by like numbers with a prime sign. In this embodiment the joy stick 23′ carries an operator member 50 which has adjustable contacts 51 and which bear on the end of operator rods 27′ and a cam member 52 which acts on a friction detent member 53. When joy stick 23′ is moved about pivot 54 the cam member 53 moves the friction detent member 53 upwardly, viewing FIG. 4, to raise detent pin 30′ and coil plate 32′. This releases operator rod 27′ and permits contact 51 to move operator rod 27′ toward the valve member 16′ which is urged toward control valve outlet port 14′ to connect inlet chamber 11′ with outlet port 14′ as in the embodiments of FIGS. 1–3. When the joy stick is returned to normal, spring 33′ forces coil plate 32′ back against coil 29′ to prevent dirt from accumulating and separating them.

In the foregoing specification I have set out certain preferred practices and embodiments of my invention, however, it will be understood that this invention may be otherwise embodied within the scope of the following claims.

I claim:

1. A magnetic joy stick and stack valve remote control structure comprising a housing having inlet and outlet chambers separated by a common inner wall, an inlet port in the housing communicating with the inlet chamber, an outlet port in the housing communicating with the outlet chamber, at least one control valve port in the housing communicating with the inlet chamber, a valve member slidable in said control valve port and connecting the control valve port with the inlet chamber in a first position and with the outlet chamber in a second position, a resiliently biased valve operator normally holding the valve in the second position, a joy stick pivoted on the housing to engage said valve operator to move the valve between the first and second position, a magnetic coil adjacent the valve operator, a detent pin movable centrally in said coil, means at one end of said detent pin for holding said valve operator in the said first position, a coil plate on said coil in contact with the detent pin opposite said means for holding the valve operator in the first position, and resilient means urging said coil plate toward the coil whereby the coil plate is in constant contact with the coil except when the detent pin forces the coil plate away from the coil when the joy stick is moved to operate the valve from one of said first and second positions to the other of said positions.

2. A magnetic joy stick and stack valve remote control structure as claimed in claim 1 wherein the valve member is an elongate member having a central bore open at the end in said control valve port and closed at the opposite end and tranvserse bore holes communicating with the central bore adjacent said other end.

3. A magnetic joy stick and stack valve remote control structure as claimed in claim 1 or 2 wherein the resiliently biased valve operator is made up of a foot plate bearing on the control valve at the end remote from the control port, a spaced head member, resilient means urging said foot plate and head member apart, a telescopic connector member between said foot plate and head member and a resilient means in the outlet chamber urging the head member away from the valve member.

4. A magnetic joy stick and stack valve assembly as claimed in claim 1 or 2 wherein the means at one end of the detent pin for holding the valve in the first position is a detent plate pivotally attached to the joy stick intermediate its ends.

5. A magnetic joy stick and stack valve assembly as claimed in claim 1 or 2 wherein the means at one end of the detent pin for holding the valve in first position is a transversely movable friction member.

* * * * *